US005582522A

United States Patent [19]

Johnson

[11] Patent Number: 5,582,522

[45] Date of Patent: Dec. 10, 1996

[54] MODULAR ELECTRICAL POWER OUTLET SYSTEM

[76] Inventor: Walter A. Johnson, 3510 Mesa Verdes Dr., El Dorado Hills, Calif. 95752

[21] Appl. No.: 610,241

[22] Filed: Mar. 4, 1996

Related U.S. Application Data

[63] Continuation of Ser. No. 228,108, Apr. 15, 1994.

[51] Int. Cl.[6] ..... H01R 4/60

[52] U.S. Cl. ..... 439/214; 439/650

[58] Field of Search ..... 439/214, 215, 439/216, 209, 119, 120

[56] References Cited

U.S. PATENT DOCUMENTS

| | | | |
|---|---|---|---|
| 2,175,144 | 10/1939 | Davison | 439/216 |
| 2,293,911 | 8/1942 | Morten et al. . | |
| 2,313,960 | 3/1943 | O'Brien | 439/216 |
| 2,317,964 | 4/1943 | O'Brien . | |
| 2,320,332 | 5/1943 | Morten . | |
| 2,351,631 | 6/1944 | O'Brien | 439/120 X |
| 2,447,026 | 8/1948 | O'Brien et al. . | |
| 2,457,831 | 1/1949 | O'Brien | 439/214 |
| 2,495,280 | 1/1950 | O'Brien et al. . | |
| 3,500,056 | 3/1970 | Riley | 439/102 |
| 3,786,312 | 1/1974 | Roussard | 361/643 |
| 4,017,137 | 4/1977 | Parks . | |
| 4,313,646 | 2/1982 | Millhimes et al. | 439/215 |
| 4,639,841 | 1/1987 | Salestrom et al. . | |
| 4,717,350 | 1/1988 | Lax | 439/92 |
| 4,872,849 | 10/1989 | Long . | |
| 4,875,871 | 10/1989 | Booty, Sr. et al. . | |
| 5,306,165 | 4/1994 | Nadeau | 439/115 |

*Primary Examiner*—Neil Abrams
*Assistant Examiner*—Barry Matthew L. Standig
*Attorney, Agent, or Firm*—John P. O'Banion

[57] ABSTRACT

A modular power outlet system employing a starter module for connection to a source of electrical power, an outlet strip module containing a plurality of power outlets, an inline passthrough coupler module for electrically connecting two or more outlet strip modules, and an inline crossover module for switching circuits to which power outlets are connected, and an end cap module for terminating an outlet strip module is disclosed herein. In a single circuit embodiment of the system, each power outlet is connected from the same electrical circuit. In a first two circuit embodiment of the system, power outlets in an outlet strip module alternate between the two circuits. A plurality of outlet strip modules can then be electrically connected using an inline passthrough coupler module. In a second two circuit embodiment of the system, each power outlet in an outlet strip module is connected to the same electrical circuit. One end of the outlet strip module is electrically connected to a two circuit starter module and the other end is electrically connected to one end of an inline crossover coupler module. A second outlet strip module is then electrically connected to the other end of the crossover module which switches the electrical circuit to which the second outlet strip module is connected. Outlet strip modules and crossover coupler modules can be successively electrically connected in this manner so as to result in a series of outlet strip modules which alternate between electrical circuits.

7 Claims, 5 Drawing Sheets

MODULAR ELECTRICAL POWER OUTLET SYSTEM

This is a continuation of copending application Ser. No. 08/228,108 filed on Apr. 15, 1994.

BACKGROUND OF THE INVENTION

1. Field of the Invention

This invention pertains generally to electrical power outlet assemblies, and more particularly to a modular raceway and outlet system employing starter modules for power conduit and conductor connection, outlet strip modules, coupler modules, and end cap modules for terminating outlet strip modules.

2. Description of the Background Art

Electrical carriers, raceways, and power outlet systems are widely used in industrial and residential environments to meet high density electrical outlet needs. Generally, electrical carriers and raceways are employed where a large number of individual electrical power outlets are required in a relatively small area for merchandise displays in retail stores, office equipment, personal computers, industrial machines, and the like. Currently used electrical carriers and raceways, however, are difficult to install and remove, requiring time-consuming, complex, and skill-intensive procedures.

For example, U.S. Pat. No. 4,875,871 issued to Booty, Sr. et al. on Oct. 24, 1989, discloses a modular electrical conductor system having a complex series of conductor tracks, switches, outlets, feed plugs, end caps, and ceiling plates. U.S. Pat. No. 4,872,849 issued to Long on Oct. 10, 1989, discloses a channel outlet having an insulated housing with a channel shaped cover which must be disassembled and reassembled for wiring. Outlets are mounted in openings in the channel shaped cover. U.S. Pat. No. 4,639,841 issued to Salestrom et al. on Jan 27, 1987, discloses a modular lighting system. U.S. Pat. No. 4,017,137 issued to Parks on Apr. 12, 1977, discloses an electrical raceway and receptacle assembly having a channel shaped cover with a plurality of receptacles mounted in the cover. The cover and raceway must be disassembled and reassembled for wiring. U.S. Pat. No. 2,495,280 issued to O'Brien et al. on Jan. 24, 1950, discloses a composite electrical conductor strip having conductor strips with mounting holes, outlet modules, and connector modules. U.S. Pat. No. 2,447,026, issued to O'Brien et al. on Aug. 17, 1948, discloses a connector unit for electric conduits. U.S. Pat. No. 2,317,964 discloses an electrical wiring system having conductor strips, modular outlets, and modular connectors. U.S. Pat. No. 2,320,332, issued to Morten on May 25, 1943, discloses an electricity conductor unit. U.S. Pat. No. 2,293,911, discloses an electricity conductor means having conductor strips, modular outlets, and modular switches.

As can be seen therefore, a variety of electrical carriers and raceways systems have been devised for different uses. As aforementioned, however, because of the disassembly and reassembly involved in installation and removal, conventional electrical outlet systems are time-inefficient and difficult to use. Some systems require disassembly of the entire carrier or raceway in order to affect a connection to a power conduit by hand wiring, followed by reassembly before final use. These procedures must be repeated if the outlet strips and raceways are removed or altered in configuration. Additionally, metal and plastic components of the carriers and raceways tend to fatigue, bend, and break due to stresses induced during disassembly and reassembly.

Therefore, there is a need for a modular electrical outlet strip system which is quickly and easily installed and removed by persons not trained or skilled as electricians. The present invention satisfies these needs, as well as others, and overcomes the deficiencies found in the prior art systems.

The foregoing patents reflect art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention pertains generally to a modular power outlet system employing a starter module for connection to a source of electrical power, an outlet strip module containing a plurality of power outlets, and an end cap module for terminating the outlet strip module. In accordance with a first aspect of the invention, one end of the outlet strip module is electrically connected to the starter module and the other end of the outlet strip module is coupled to the end cap module. In accordance with another aspect of the invention, a plurality of outlet strip modules are joined using an inline passthrough coupler module.

Each power outlet can be connected to a single electrical circuit or, if desired, power outlets can be connected to different electrical circuits for load balancing. In a first two circuit embodiment, power outlets in an outlet strip module alternate between the two circuits. A plurality of outlet strip modules can then be electrically connected using an inline passthrough coupler module. In a second two circuit embodiment, each power outlet in an outlet strip module is connected to the same electrical circuit. One end of the outlet strip module is electrically connected to a two circuit starter module and the other end is electrically connected to one end of an inline crossover coupler module. A second outlet strip module is then electrically connected to the other end of the crossover module which switches the electrical circuit to which the second outlet strip module is connected. Outlet strip modules and crossover coupler modules can be successively electrically connected in this manner so as to result in a series of outlet strip modules which alternate between electrical circuits.

By way of example and not of limitation, a starter module includes one or more knockout plugs and associated feed holes near one end for receiving a power conduit, wire terminating lugs for connecting to an electrical circuit running through the power conduit, and a male plug on the other end with each prong being electrically connected to a respective wire terminating lug. In an alternative embodiment of the starter module the starter module includes a male plug at each end and also functions as an inline coupler module. An outlet strip module includes a female receptacle at each end, a plurality of power outlets, and a plurality of electrical conductors running between the female receptacles and the power outlets. An end cap module includes a male plug at each end with each prong being electrically isolated. An inline passthrough coupler module includes a male plug at each end and a plurality of electrically conductors running between the plugs. A two circuit pass through coupler includes a four-prong male plug at each end and plurality of electrical conductors running between the plugs, with hot legs at each end being interchanged.

Each male plug is configured to mate with any of the female receptacles, but not with the power outlets. In a single circuit system, each male plug includes three prongs, each female receptacle includes three contacts, and each power outlet includes three contacts. In a two circuit system, each male plug includes four prongs and each female receptacle includes four contacts; however, each power outlet still includes three contacts. In addition, each module includes means for attaching the module to a wall or work surface.

An object of the invention is to provide a modular electrical outlet strip system that allows for facile, time-efficient installation and removal.

Another object of the invention is to provide a modular electrical outlet strip system that does not require disassembly and reassembly in order for connection and disconnection with a power conduit.

Another object of the invention is to provide a modular electrical outlet strip system that is easy and simple to work with so that persons without training as electricians can add or remove modules as desired.

Another object of the invention is to provide a modular electrical outlet strip system that is safe to use, with minimal risk of electric shock to users.

Another object of the invention is to provide a modular electrical outlet strip system that can easily be reconfigured into a variety of circuit combinations.

Another object of the invention is to provide a modular electrical outlet strip system that is aesthetically pleasant, resilient, and scratch and dent resistant, and compatible with wall, floor, ceiling, table, and bench surfaces.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
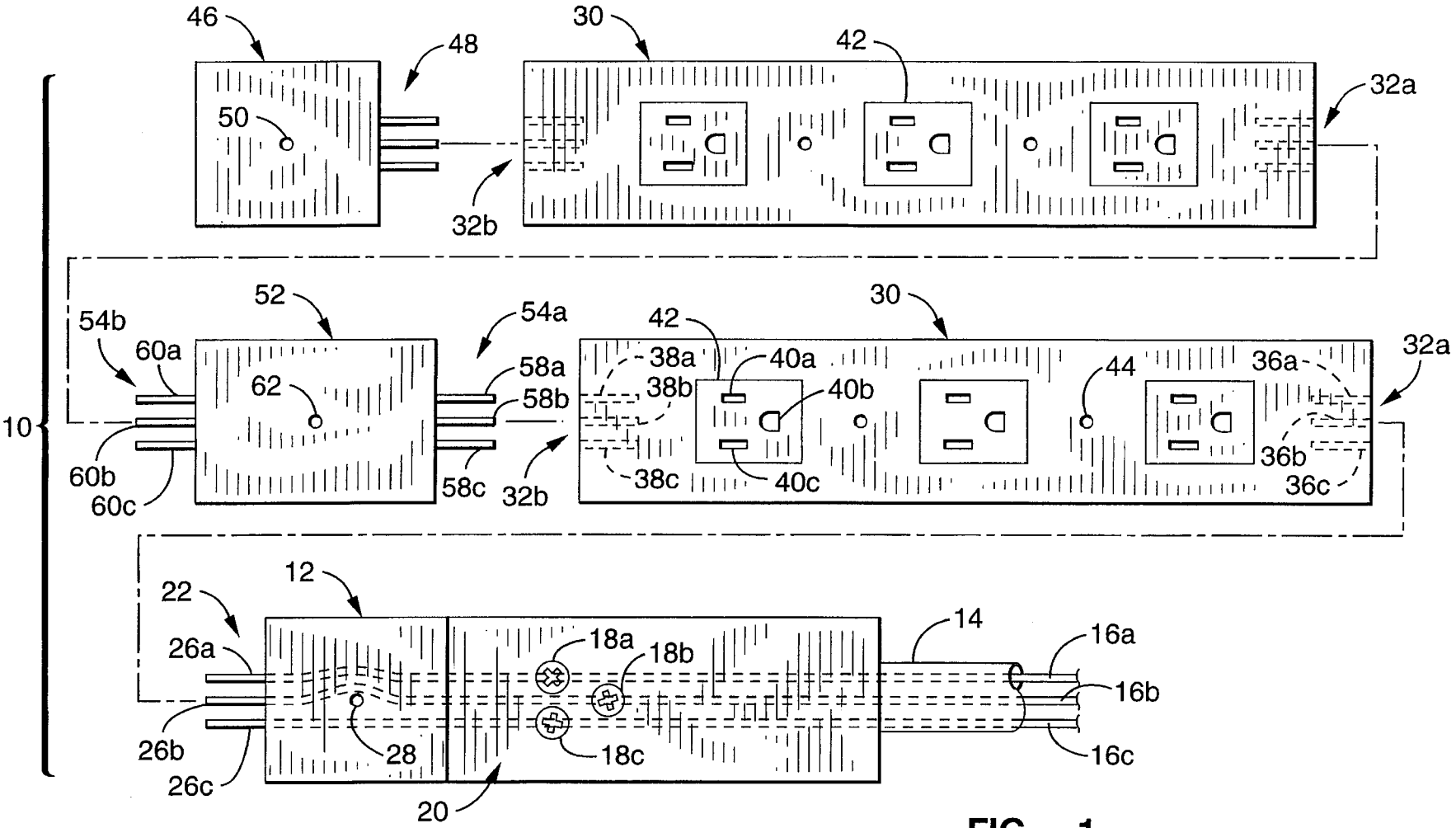
FIG. 1 is a diagrammatic plan view of a one-circuit modular electrical power outlet system in accordance with the present invention, showing the various components of the system in a separated position.

Referring more specifically to the drawings, for illustrative purposes the present invention embodied in the modular electrical outlet system which is generally shown in FIG. 1 through FIG. 10 where like reference numerals denote like pans. It will be appreciated that the system may vary as to configuration and as to details of the pans without departing from the basic concepts as disclosed herein.

Figure 2:
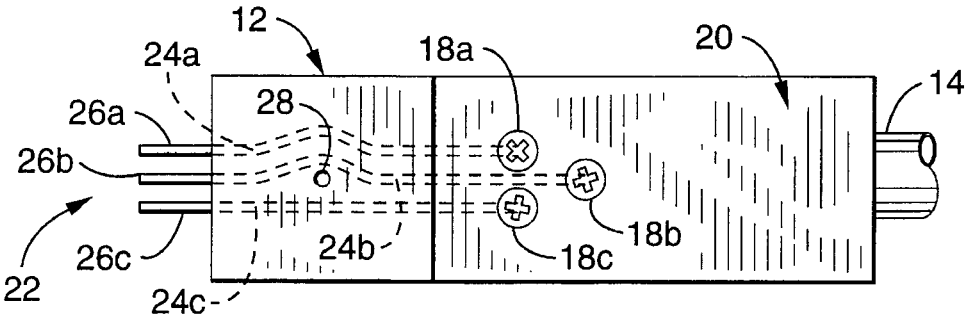
FIG. 2 is a diagrammatic plan view of a starter module showing the terminal lug compartment cover removed, and showing the electrical conductors electrically connecting the male prongs and the terminal lugs.

Referring first to FIG. 1, a one circuit modular electrical outlet strip system 10 in accordance with the present invention is generally shown. A source of electrical power is obtained by electrically connecting a starter module 12 to a conductor carrying conduit 14 and electrically connecting the conductors 16*a*, 16*b*, 16*c* to corresponding terminal lugs 18*a*, 18*b*, 18*c* in terminal lug compartment 20. Here, terminal lug compartment 20 is illustrated with its cover (not shown) removed, which would be removed and replaced for wiring starter module 12. Additionally, while conduit 14 is shown coupled to the end of starter module 12, it will be appreciated that feed holes and associated knockout plugs could be provided so that conduit 14 could enter terminal lug compartment 20 from the top, bottom or back as well. Starter module 12 has first and second ends, one end of which is electrically connected to conductor carrying conduit 14 and the other end of which includes a three-prong male plug 22 or the like as an end connector. Referring also to FIG. 2, a plurality of conductors 24*a*, 24*b*, 24*c* couple individual prongs 26*a*, 26*b*, 26*c* in plug 22 to their corresponding terminal lugs 18*a*, 18*b*, 18*c*. A mounting hole 28 is also provided for affixing starter module 12 to a wall or work surface using a screw (not shown) or other conventional fastener.

Figure 3:
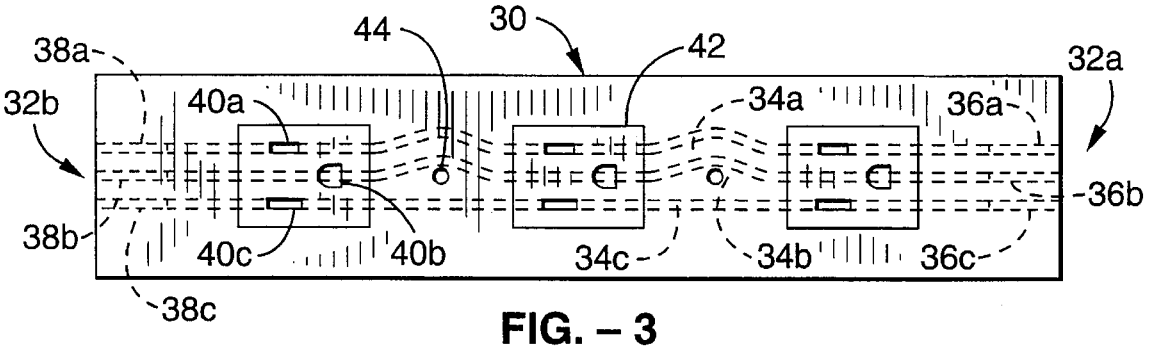
FIG. 3 is a diagrammatic plan view of an outlet strip module of the system shown in FIG. 1 showing the electrical conductors electrically connecting the female receptacles and the corresponding terminals in the power outlets.

Referring also to FIG. 3, an outlet strip module 30 has first and second ends, each of which includes a three-contact female receptacle 32*a*, 32*b* or the like, respectively, as an end connector. A plurality of conductors 34*a*, 34*b*, 34*c* couple individual contacts 36*a*, 36*b*, 36*c* in receptacle 32*a* and individual contacts 38*a*, 38*b*, 38*c* in receptacle 32*b* to corresponding outlet terminals 40*a*, 40*b*, 40*c* in power outlets 42. Preferably, power outlets 42 are of the three-contact configuration designed to accommodate the grounded plugs commonly used for electrical appliances, machines, and the like, in which case outlet terminal 40*a* would correspond to the hot leg, outlet terminal 40*b* would correspond to the ground leg, and outlet terminal 40*c* would correspond to the neutral leg. Additionally, the configuration illustrated in FIG. 3 shows a total of three power outlets 42, while any number can be used subject only to current and/or voltage drop limitations. Further, those skilled in the art will appreciate that the spacing of the power outlets can vary, such as placing the power outlets on three inch, six inch, twelve inch, or eighteen inch centers. As can be seen, therefore, the three-prong male plug 22 in starter module 12 will reversibly engage the three-contact female receptacles 32*a*, 32*b* in outlet strip module 30 in a mating fashion to provide an electrical connection. A mounting hole 44 is also provided for affixing outlet strip module 30 to a wall or work surface using a screw (not shown) or other conventional fastener.

Referring again to FIG. 1, an outlet strip module 30 is electrically connected to a starter module 12 by inserting male plug 22 into female receptacle 32*a* (or 32*b* since each end of outlet strip module is identical). For safety reasons, it is desirable to terminate the assembly using a end cap module 46 so that female receptacle 32*b* is not left uncovered. End cap module 46 includes a three-prong male plug 48 or the like as an end connector on one end which is isolated from the remainder of end cap module 46. By inserting male plug 48 into female receptacle 32*b*, the openings in the receptacle are capped off and, as a result, it is not possible for dirt to accumulate or for foreign objects to be inserted into female receptacle 32*b*. A mounting hole 50 is also provided for affixing end cap module 46 to a wall or work surface using a screw (not shown) or other conventional fastener.

Figure 4:
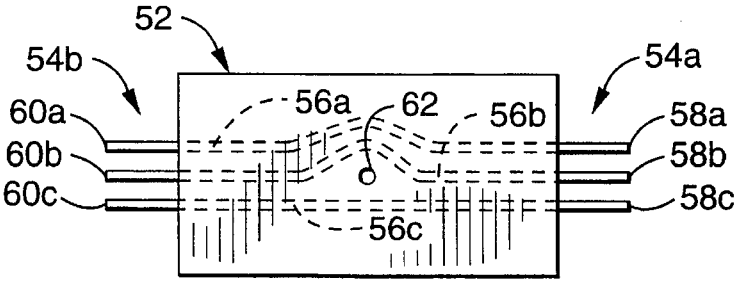
FIG. 4 is a diagrammatic plan view of an inline passthrough coupler module of the system shown in FIG. 1 showing the electrical conductors electrically connecting the male prongs.

While it has been indicated earlier that outlet strip module 30 can include any number of power outlets 42, it is neither practical nor desirable to make an outlet strip module 30 of indefinite length. Therefore, it is contemplated that a plurality of outlet strip modules 30 be used in order to increase the number of available power outlets 42. For that purpose, an inline passthrough coupler module 52 is provided. Referring also to FIG. 4, inline passthrough coupler module 52 has first and second ends, each of which includes a three-prong male plug 54*a*, 54*b* or the like, respectively, as an end connector. A plurality of conductors 56*a*, 56*b*, 56*c* couple individual prongs 58*a*, 58*b*, 58*c* in plug 54*a* and individual prongs 60*a*, 60*b*, 60*c* in plug 54*b* in a "straightline" or "passthrough" electrical configuration as shown. A mounting hole 60 is also provided for affixing inline passthrough coupler module 52 to a wall or work surface using a screw (not shown) or other conventional fastener.

By inserting male plug 54*a* into a female receptacle 32*b* on a first outlet strip module and, further, by inserting male plug 54*b* into a female receptacle 32*a* on a second outlet strip module, the two modules can be electrically connected as shown. Any number of outlet strip modules can be electrically connected in this manner, limited only by the practical length of a run due to current capacity and permissible voltage drop.

Figure 5:
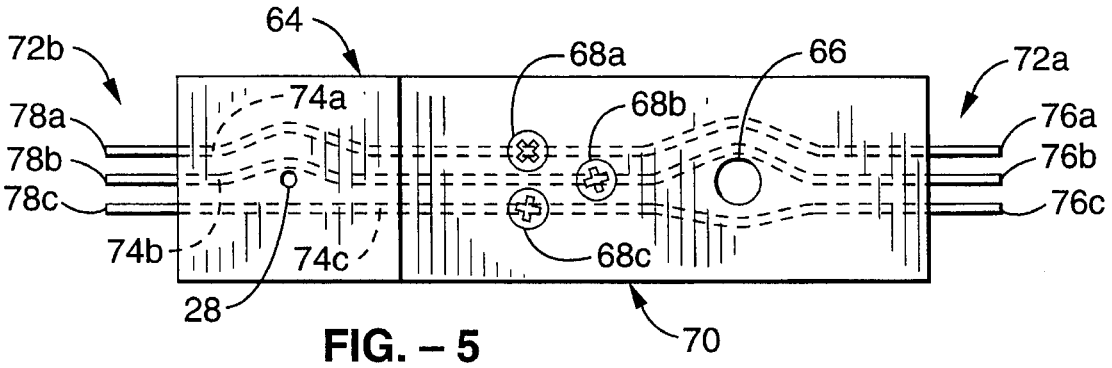
FIG. 5 is a diagrammatic plan view of an alternative embodiment of the starter module shown in FIG. 2 configured for inline use, showing the terminal lug compartment cover removed, and showing the electrical conductors electrically connecting the male prongs and terminal lugs.

Referring again to FIG. 1 and FIG. 2, it can be seen that starter module 12 is configured with a male plug 22 on one end and is electrically connected to a conductor carrying conduit 14 on the other end. In this configuration, conductor carrying conduit 14 is connected inline, wherein its longitudinal axis is aligned with the longitudinal axis between the ends of starter module 12. Referring also to FIG. 5, it may be desirable to tap the source of electrical power at an angle in relation to the longitudinal axis through starter module 12 and, therefore, an inline coupler starter module 64 is provided. Inline coupler starter module 64 includes a conduit feed opening 66 of the module for coupling to conductor carrying conduit 14 and conductors 16*a*, 16*b*, 16*c* to corresponding terminal lugs 68*a*, 68*b*, 68*c* in terminal lug compartment 70. While feed opening 66 is shown in the back of terminal lug compartment in the embodiment described herein, a plurality of feed openings and associate knockout plugs can be provided so that conduit 14 can enter terminal lug compartment from the top, bottom or back as well. Here, terminal lug compartment 70 is illustrated with its cover (not shown) removed, which would be removed and replaced for wiring inline coupler starter module 64. Inline coupler starter module 64 has first and second ends, each of which includes a three-prong male plug 72*a*, 72*b*, or the like, respectively, as an end connector. A plurality of conductors 74*a*, 74*b*, 74*c* couple individual prongs 76*a*, 76*b*, 76*c* in plug 72*a* and individual prongs 78*a*, 78*b*, 78*c* in plug 72*b* in a "straightline" or "passthrough" electrical configuration as shown. By using the inline coupler starter module 64, an outlet strip module 28 can be electrically connected at each end and the system can thus be extended in two directions, ultimately being terminated with two end cap modules 46.

As indicated previously, any number of outlet strip modules may be electrically connected subject only to current and/or voltage drop limitations. Where such limitations apply, it may not be desirable or practical to install additional "runs" of outlet strip modules. Instead, it may be desirable to run additional electrical circuits with outlet strip modules connected to particular electrical circuits for load balancing. Such capability is provided for in the configuration shown in FIG. 6 where a four wire, two circuit system is employed as an alternative to the three wire, one circuit system heretofore described.

Figure 6:
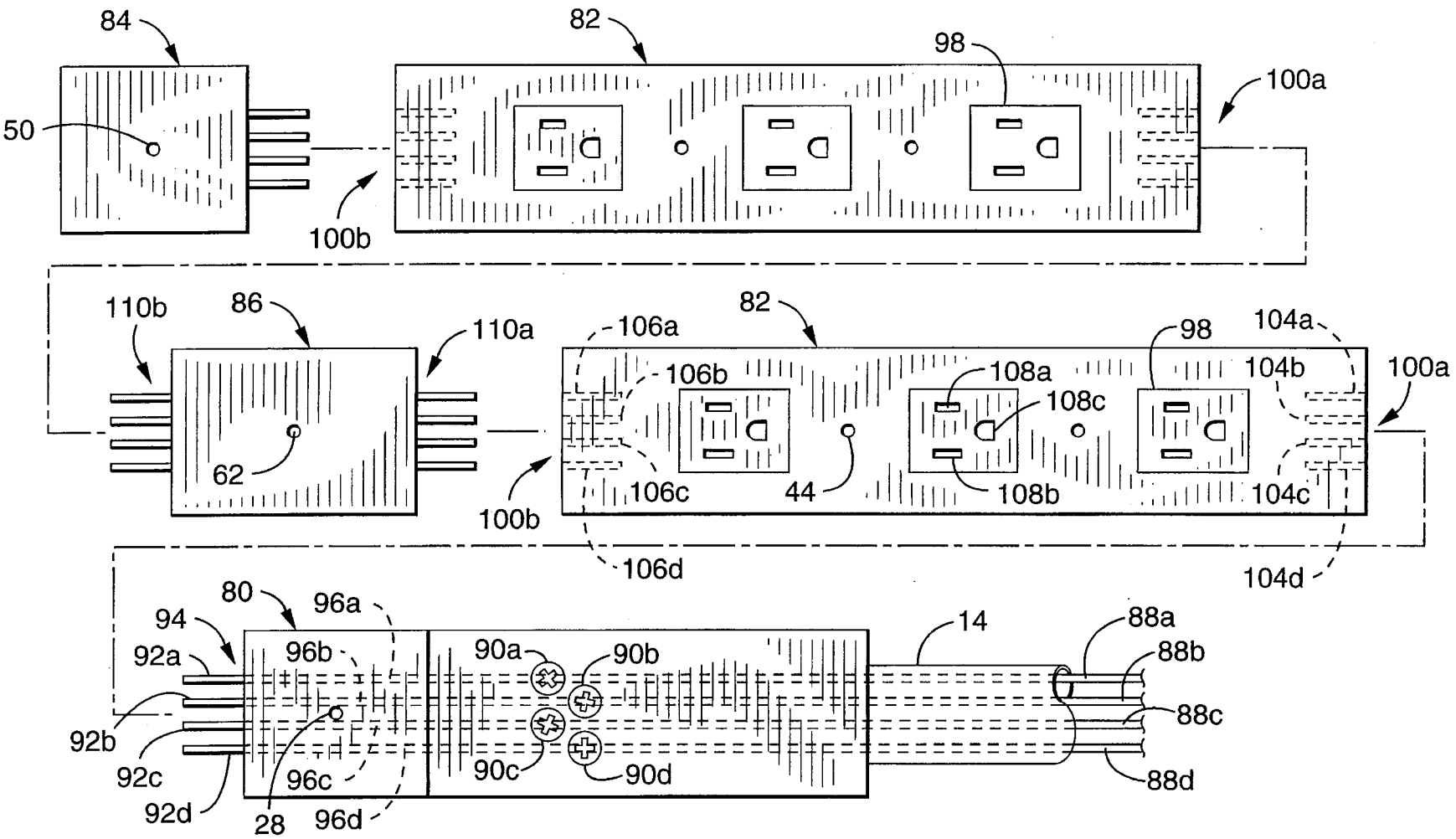
FIG. 6 is a diagrammatic plan view of a two-circuit modular electrical power outlet system in accordance with the present invention, showing the various modules of the system in a separated position.

FIG. 6 generally shows the same configuration as shown in FIG. 1 with the exception that all of the male plugs, female receptacles and associated wiring are of a four wire configuration; however, the power outlets are of a three wire configuration as before. Therefore, the aspects of the invention previously described apply to this configuration except where otherwise indicated. As with the system shown in FIG. 1, the four wire, two circuit system includes a starter module 80, an outlet strip module 82, an end cap module 84 and an inline passthrough coupler module 86.

Starter module 80 is electrically connected to a four wire conductor system where conductor 88*a* is a hot leg on the first circuit, conductor 88*b* is the hot leg on a second circuit, conductor 88*c* is the ground leg, and conductor 88*d* is the neutral leg. Such conductors are connected to terminal lugs 90*a*, 90*b*, 90*c*, 90*d*, respectively, which in turn are connected to prongs 92*a*, 92*b*, 92*c*, 92*d* in a four-prong male plug 94 or the like through conductors 96*a*, 96*b*, 96*c*, 96*d*, respectively.

Figure 7:
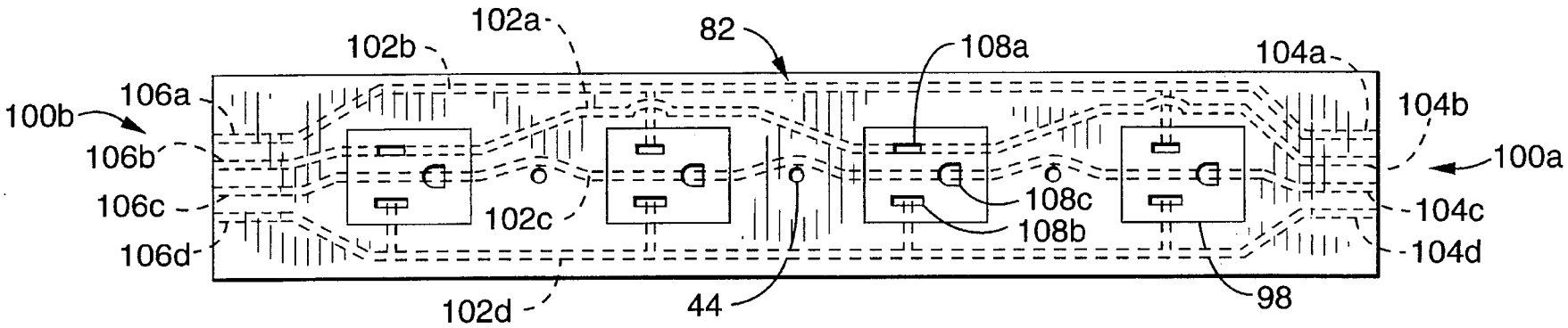
FIG. 7 is a diagrammatic plan view of a two circuit outlet strip module of the system shown in FIG. 6 showing the electrical conductors electrically connecting the female receptacles and corresponding terminals in the power outlets and showing two power outlets electrically connected to a first circuit and two power outlets electrically connected to a second circuit in an alternating configuration.

Referring also to FIG. 7, an "alternating circuit" outlet strip module 82 is shown. In this embodiment, outlet strip module 82 preferably includes a number of power outlets 98 which is a multiple of two. Outlet strip module 82 has first and second ends, with a four-contact female receptacle 100*a*, 100*b* or the like, respectively, at each end as an end connector. A plurality of conductors 102*a*, 102*b*, 102*c*, 102*d* runs through outlet strip module 82 and couples individual contacts 104*a*, 104*b*, 104*c*, 104*d* in receptacle 100*a* and individual contacts 106*a*, 106*b*, 106*c*, 106*d* in receptacle 100*b*, respectively. Conductors 102*c*, 102*d* are connected to corresponding outlet terminals 108*b*, 108*c* in each power outlet 98, respectively. However, outlet terminals 108*a* alternate between conductors 102*a* and 102*b* as shown so that every other power outlet is on the same circuit. In this manner, half of the power outlets 98 are connected to the first electrical circuit, while the other half of the power outlets 98 are connected to the second electrical circuit. In this way, the power outlets are balanced among two circuits.

Figure 8:
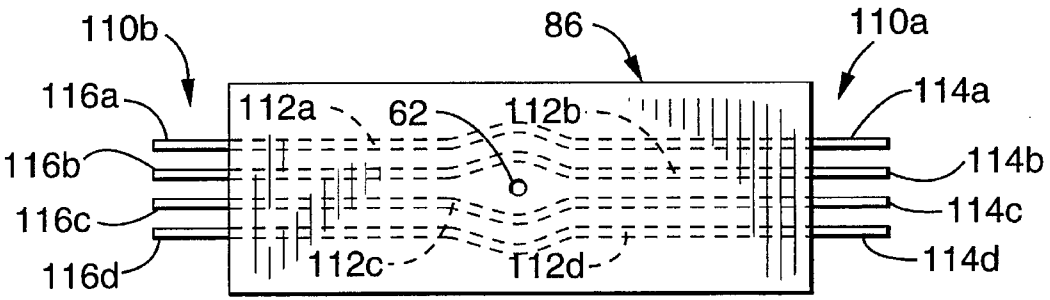
FIG. 8 is a diagrammatic plan view of an inline passthrough coupler module of the system shown in FIG. 6 showing the electrical conductors electrically connecting the male prongs.

Referring also to FIG. 8, an inline passthrough coupler module 86 is provided. Inline passthrough coupler module 86 has first and second ends, each of which includes a four-prong male plug 110*a*, 110*b*, or the like, respectively, as an end connector. A plurality of conductors 112*a*, 112*b*, 112*c*, 112*d* couple individual prongs 114*a*, 114*b*, 114*c*, 114*d* in plug 110*a* and individual prongs 116*a*, 116*b*, 116*c*, 116*d* in plug 110*b* in a "straightline" or "passthrough" electrical configuration as shown. By inserting male plug 110*a* into a female receptacle 100*b* on a first outlet strip module and, further, by inserting male plug 110*b* into a female receptacle 100*a* on a second outlet strip module, the two modules can be electrically connected as shown. Any number of outlet strip modules can be electrically connected in this manner, limited only by the practical length of a run due to current capacity and permissible voltage drop. Those skilled in the art will appreciate that, while the preferred embodiment contains no more than two electrical circuits, the modules as described could be configured for three or more electrical circuits subject to meeting Underwriter's Laboratory, National Electric Code, and other safety standards regarding conductor spacing. For example, in a three circuit embodiment the power outlets would not alternate among circuits but every third power outlet would be connected to the same circuit.

Figure 9:
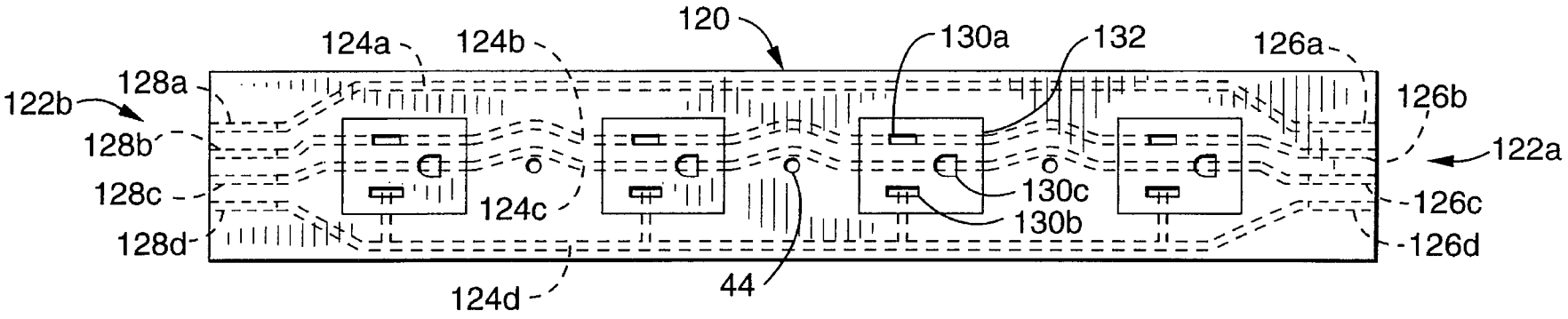
FIG. 9 is a diagrammatic plan view of an alternative embodiment of the outlet strip module showing in FIG. 7 showing the electrical conductors electrically connecting the female receptacles and corresponding terminals in the power outlets and showing each power outlet electrically connected to the same circuit, and further showing an additional circuit between the female receptacles which bypasses the power outlets.

However, the foregoing configuration requires that each outlet strip module contain power outlets which are connected to different circuits. It may be desirable, however, to connect multiple outlet strip modules together where all of the power outlets in one outlet strip module are connected to the same first circuit and all of the power outlets in the next outlet strip module are connected to the same second circuit; in other words, instead of alternating circuits among power outlets in the outlet strip module, the outlet strip modules are alternated among circuits. For such a configuration, the straightline outlet strip module 120 shown in FIG. 9 is used. Outlet strip module 120 has first and second ends, with a four-contact female receptacle 122*a*, 122*b* or the like, respectively, at each end as an end connector. A plurality of conductors 124*a*, 124*b*, 124*c*, 124*d* runs through outlet strip module 120 and couple individual contacts 126*a*, 126*b*, 126*c*, 126*d* in receptacle 122*a* and individual contacts 128*a*, 128*b*, 128*c*, 128*d* in receptacle 122*b*, respectively. Conductors 124*b*, 124*c*, 124*d* are connected to corresponding outlet terminals 130*a*, 130*b*, 130*c* in each power outlet 132, respectively. However, conductor 124*a* bypasses power outlets 132.

Figure 10:
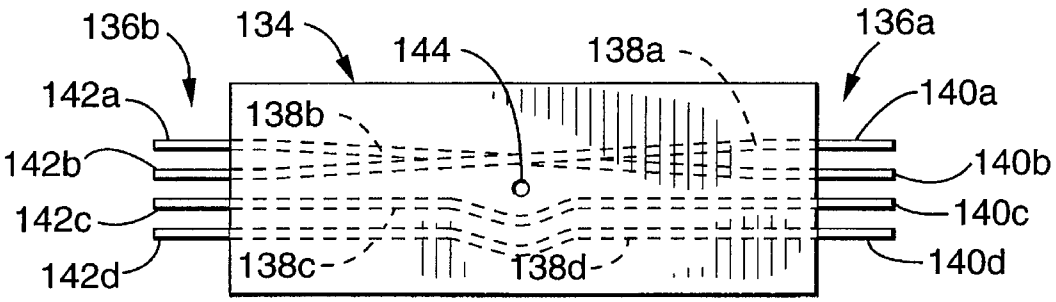
FIG. 10 is a diagrammatic plan view of an inline crossover coupler module of the system shown in FIG. 6 used with the outlet strip module shown in FIG. 9, and showing the electrical conductors electrically connecting the male prongs and showing a crossover connection between the two circuits.

As can be seen, therefore, if a plurality of outlet strip modules 120 are electrically connected using the inline passthrough coupler module 86 shown in FIG. 8, all of the power outlets 132 will be connected to the same electrical circuit. To switch to a different circuit, inline crossover coupler module 134 shown in FIG. 10 is used. Crossover coupler module 134 has first and second ends, each of which includes a four-prong male plug 136*a*, 136*b* or the like, respectively, as an end connector. Conductors 138*c*, 138*d* couple individual prongs 140*c*, 140*d* in plug 136*a* to individual prongs 142*c*, 142*d* in plug 136*b*, respectively. However, conductor 138*a* couples prong 140*a* in plug 136*a* to prong 142*b* in plug 136*b*; and conductor 138*b* couples prong 140*b* in plug 136*a* to prong 142*a* in plug 136*b*. Since there is no connection between conductors 138*a* and 138*b*, prongs 140*a*, 140*b* are "switched" in their relative connective positions in relation to prongs 142*a*, 142*b*. A mounting hole 144 is also provided for affixing crossover coupler module 134 to a wall or work surface using a screw (not shown) or other conventional fastener.

In this way, a first outlet strip module would be electrically connected to a starter module 80 by inserting plug 94 into receptacle 122*a*. Then, plug 136*a* in crossover coupler module 134 would be inserted into receptacle 122*b* of the first outlet strip module. Next, plug 136*b* in crossover coupler module 134 would be inserted into receptacle 122*a* of a second outlet strip module. As a result, each power outlet 132 in the first outlet strip module would be connected to the hot leg associated with conductor 88*b* in power conduit 14, and each power outlet 132 in the second outlet strip module would be connected to the hot leg associated with conductor 88*a* in power conduit 14. Those skilled in the art will appreciate that various combinations of outlet strip modules 120, inline passthrough modules 86, and inline crossover coupler modules 134 can be selected to provide as many power outlets 132 on each circuit as desired, subject only to current carrying and voltage drop limitations. It will further be appreciated that, while a two circuit system has been described, the same modules can be adapted for three or more electrical circuits, subject to applicable safety standards for conductor spacing as described previously.

In the preferred embodiment of the invention outlet strip modules have female receptacles on each end for safety. In this way, if an end cap is not used to terminate the system the electrical contacts will not be exposed. However, alternative embodiments of the invention are contemplated where different arrangements of male plugs and female receptacles are employed. In one embodiment, the positions of the male plugs and female receptacles are switched, resulting in the starter module having a female receptacle, the outlet strip module having male plugs, and the end cap-modules and coupler modules (passthrough and crossover) having female receptacles. In another embodiment, the outlet strip modules have a female receptacle at one end and a male plug at the other end. The starter module would have a female receptacle, the end cap module would have a male plug, and the coupler modules would have a female receptacle at one end and a male plug at the other end. In yet another embodiment, the outlet strip modules would have a female receptacle at one end and a male plug at the other end, the end cap module would have a female receptacle, the starter module would have a male plug, and the coupler modules would have a female receptacle at one end and a male plug at the other end.

While the above embodiments show particular circuit configurations for the outlet strip and coupling modules, it will be appreciated-that a variety of such configurations with different numbers and arrangements of conductors and outlet receptacles are possible, and are considered as within the scope of the present invention. Additionally, it will be appreciated that, while the coupler modules heretofore described have been of an inline configuration, other configurations are contemplated. Coupler modules having "X", "T", and "L" shaped configurations can be employed to facilitate system extensions in other various directions.

Preferably, the end cap modules, outlet strip modules, and coupler modules are molded or extruded as unitary components from a plastic or other natural or made-made polymer with high electrical insulating characteristics. In this way, no manual wiring of those components would be required during installation of the system. Further, use of plastic materials or the like provide an aesthetically pleasing, resilient, scratch and dent resistant housing for the plugs, connectors, outlets and wiring. The starter modules are preferably molded from an insulating matrix with embedded conductors and prongs, except that a separable cover is employed to gain access to the terminal lug compartment for connection of the terminal lugs to a power source. The end cap modules are molded from an insulating matrix or the like with the end connectors terminating therein. Preferably the components are substantially rigid, although it should be appreciated that coupler modules (and other modular parts) with articulating ability are also considered as within the scope of this disclosure.

Preferably the conductors used in the various modules of the present invention are fabricated from copper, aluminum, or other conductive metal or metallic alloy. The conductors can be individually insulated, or bare conductors can be embedded in the insulating matrix or suspended by insulating contacts within the individual modular components.

Accordingly, it will be seen that this invention provides a modular electrical outlet strip system which permits a plurality of outlet strip modules to be connected in a variety of configuration, while providing improved ease of installment and removal and improved aesthetic appearance for this type of electrical outlet system. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A multiple circuit modular power outlet system, comprising:

(a) a starter module, said starter module having first and second ends, at least one of said ends including an electrical end connector, said starter module including means for electrically connecting said end connector to a plurality of electrical power circuits, each said circuit having separate hot legs; and (b) an outlet strip module, said outlet strip module having first and second ends, said outlet strip module including an electrical end connector at each end, said outlet strip module including at least four electrical conductors extending between said electrical end connectors, said electrical conductors including two hot legs, a neutral leg and a ground leg, said outlet strip module including at least three adjacent power outlets, each said power outlet including a hot leg terminal, said hot terminal of each said power outlet being electrically connected to a different one of said hot legs than the hot leg terminal of an adjacent power outlet in an alternating configuration;

(c) said electrical end connector associated with said starter module including means for reversibly engaging said electrical end connectors associated with said outlet strip module.

2. A multiple circuit modular power outlet system as recited in claim 1, wherein said means for electrically connecting said end connector associated with said staffer module to a source of electrical power comprises a plurality of conductor terminating lugs.

3. A multiple circuit modular power outlet system as recited in claim 1, further comprising at least one passthrough coupler module, said passthrough coupler module having first and second ends, said passthrough coupler module including an electrical end connector on each end, said passthrough coupler module including a plurality of electrical conductors extending between said electrical end connectors, said electrical end connector including means for reversibly engaging said electrical end connectors associated with said outlet strip module.

4. A multiple circuit modular power outlet system as recited in claim 1, further comprising an end cap module, said end cap module including an electrical end connector on one end, said electrical end connector terminating in an insulating material, said electrical end connector including means for reversibly engaging said electrical end connectors associated with said outlet strip module.

5. A modular electrical power outlet system for providing power outlets connected to multiple electrical circuits, comprising:

(a) a starter module, said starter module having first and second ends, at least one of said ends including an electrical end connector, said starter module including means for electrically connecting said end connector to a plurality of electrical power circuits, each said circuit having separate hot legs;

(b) at least one outlet strip module, said outlet strip module having first and second ends, said outlet strip module including an electrical end connector at each end, said outlet strip module including at least four electrical conductors extending between said electrical end connectors, said electrical conductors including two hot legs, a neutral leg and a ground leg, said outlet strip module including a plurality of power outlets, each said power outlet including a hot leg terminal, said hot leg terminal associated with each said power outlet being electrically connected to a said one of said plurality of said hot legs, said other electrical circuits bypassing said power outlets;

(c) said electrical end connector associated with said starter module including means for reversibly engaging said electrical end connectors associated with said outlet strip module; and (d) a crossover coupler module, said crossover coupler module having first and second ends, said crossover coupler module including a first electrical end connector on said first end, said crossover coupler module including a second electrical end connector on said second end, said crossover coupler module including at least four electrical conductors extending between said electrical end connectors, said electrical conductors including first and second hot legs, a neutral leg and a ground leg, said first hot leg conductor and said second hot leg conductor having a positional relationship in said first end connector, said first hot leg conductor and said second hot leg conductor having a different positional relationship in said second end connector, said electrical end connectors including means for reversibly engaging said electrical end connectors associated with said outlet strip module.

6. A modular electric power outlet system as recited in claim 5, further comprising at least one passthrough coupler module, said passthrough coupler module having first and second ends, said passthrough coupler module including an electrical end connector on each end, said passthrough coupler module including a plurality of electrical conductors extending between said electrical end connectors, said electrical end connector including means for reversibly engaging said electrical end connectors associated with said outlet strip module.

7. A modular electric power outlet system as recited in claim 5, further comprising an end cap module, said end cap module including an electrical end connector on one end, said electrical end connector terminating in an insulating material, said electrical end connector including means for reversibly engaging said electrical end connectors associated with said outlet strip module.

* * * * *